US008422714B2

(12) United States Patent
Peng

(10) Patent No.: US 8,422,714 B2
(45) Date of Patent: Apr. 16, 2013

(54) SPEAKER WITH ACOUSTIC CHAMBER

(75) Inventor: Da-Yi Peng, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 99 days.

(21) Appl. No.: 12/954,554

(22) Filed: Nov. 24, 2010

(65) Prior Publication Data

US 2012/0063626 A1 Mar. 15, 2012

(30) Foreign Application Priority Data

Sep. 10, 2010 (CN) ..... 2010 1 0278439

(51) Int. Cl.
*H04R 1/02* (2006.01)

(52) U.S. Cl.
USPC ..... 381/345; 381/398; 181/155; 181/156; 181/219

(58) Field of Classification Search ..... 381/345, 381/398; 181/155, 156, 219
See application file for complete search history.

(56) References Cited

U.S. PATENT DOCUMENTS 4,164,988 A * 8/1979 Virva ..... 181/156
6,236,724 B1 * 5/2001 Labaton et al. ..... 379/357.03
6,738,487 B1 * 5/2004 Nageno et al. ..... 381/322

* cited by examiner

*Primary Examiner* — Davetta W Goins
*Assistant Examiner* — Amir Etesam
(74) *Attorney, Agent, or Firm* — Altis Law Group, Inc.

(57) ABSTRACT

A speaker with acoustic chamber is provided. The speaker includes a main body and an acoustic chamber fixed to the main body. The acoustic chamber can be converted between a collapsed state and an expanded state. The acoustic chamber is drawn to the expanded state to increase the volume of the acoustic chamber and is collapsed to the collapsed state to decrease the volume of the acoustic chamber. When the acoustic chamber is drawn to the expanded state, the quality of the sound output by the speaker is improved.

6 Claims, 3 Drawing Sheets

SPEAKER WITH ACOUSTIC CHAMBER

BACKGROUND

1. Technical Field

The present disclosure relates to a speaker with an acoustic chamber.

2. Description of Related Art

With miniaturization requirements of electronic devices, such as mini-computers, speakers thereof are often made without an acoustic chamber or provide less volume for the acoustic chamber, which results in interference with the acoustic wave output by the speaker, diminishing quality of sound output.

BRIEF DESCRIPTION OF THE DRAWINGS

The components of the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
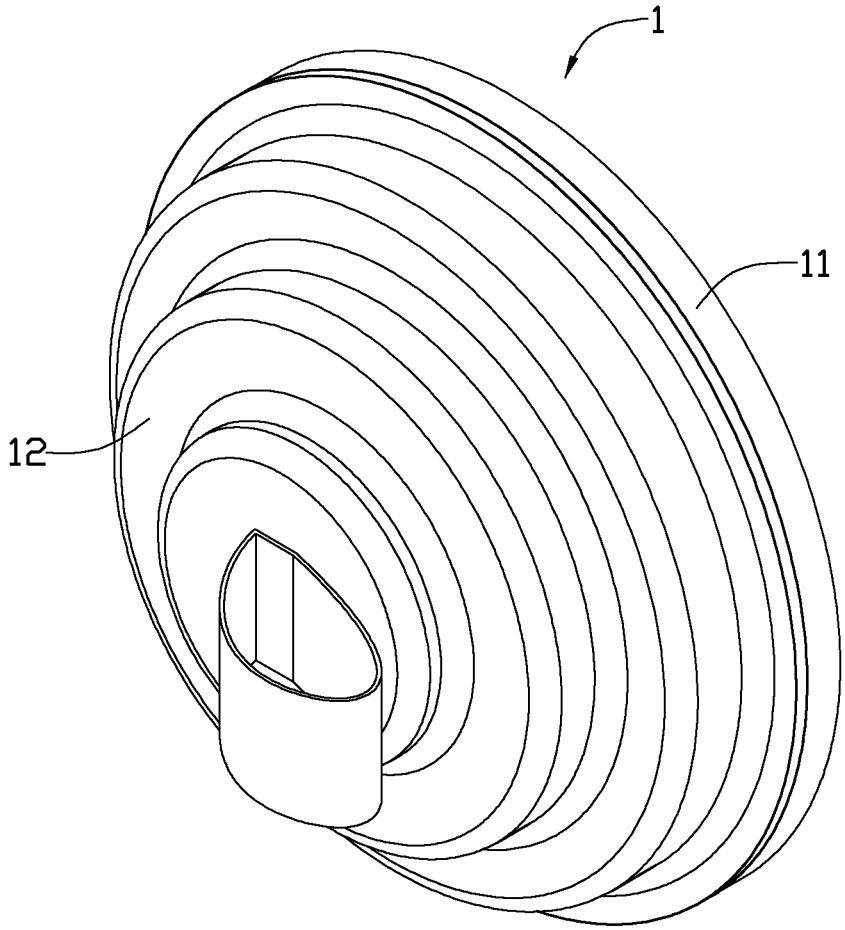
FIG. 1 is an isometric view of a speaker with an acoustic chamber in accordance with an exemplary embodiment.
Figure 2:
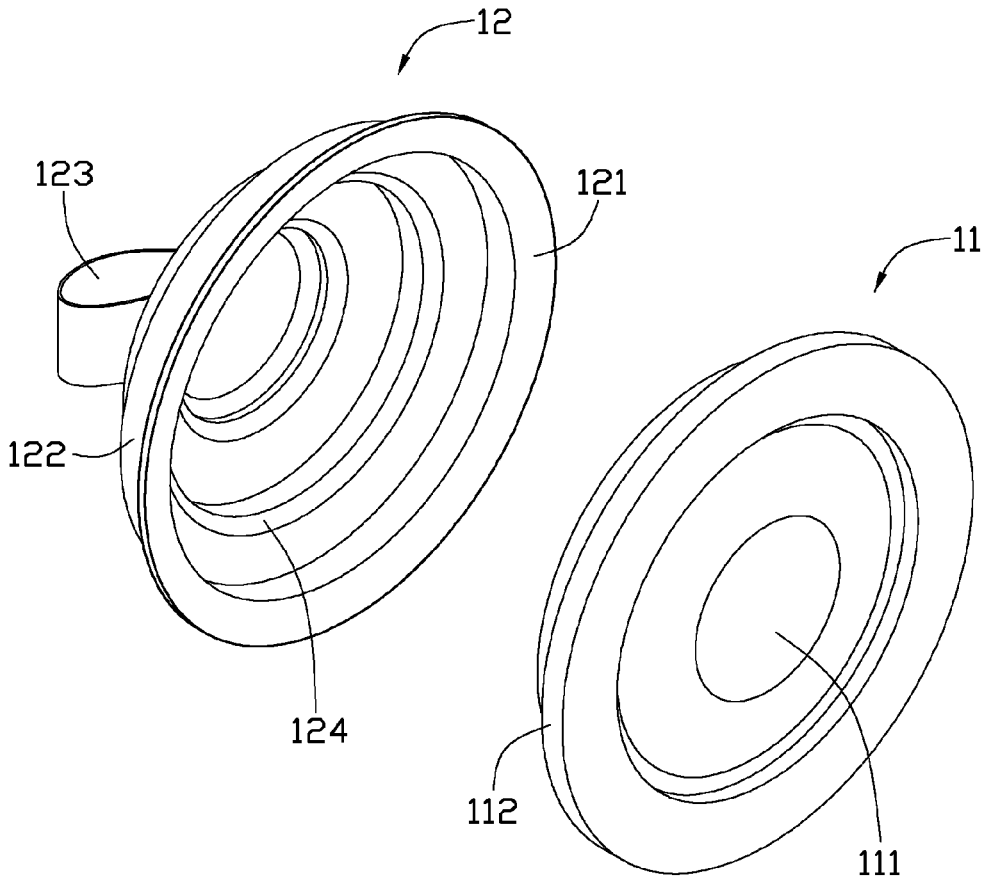
FIG. 2 is an exploded view of a speaker of FIG. 1 with a chamber of the speaker expanded.

Referring to FIGS. 1 and 2, a speaker 1 includes a main body 11 and an acoustic chamber 12. The acoustic chamber 12 is fixed to the main body 11. The main body 11 generates acoustic waves. The acoustic chamber 12 reduces interference of the acoustic waves generated by the main body 11.

The main body 11 includes an acoustic wave generating part 111 and a connection part 112. The acoustic wave generating part 111 generates the acoustic wave. The connection part 112 connects the acoustic chamber 12.

The acoustic chamber 12 includes a connection part 121, a chamber 122, and a band 123. The connection part 112 of the main body 11 attaches to the connection part 121 of the acoustic chamber 12 to connect the acoustic chamber 12 to the main body 11.

Figure 3:
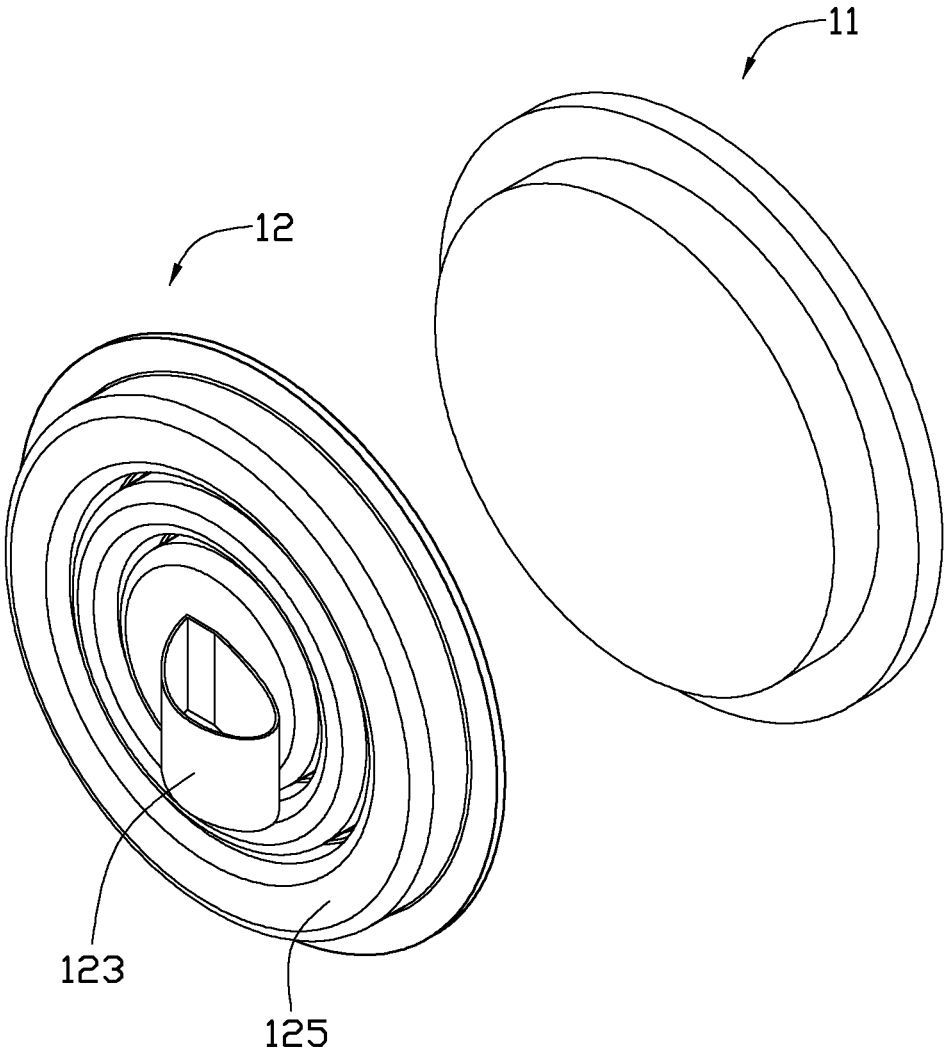
FIG. 3 is an exploded view of a speaker of FIG. 1 with the chamber of the speaker collapsed.

The band 123 is fixed to the chamber 122. The chamber 122 can be converted between a collapsed state and an expanded state by drawing or pushing the band 123. For example, in FIGS. 1 and 2, the chamber 122 is in the expanded state, and in FIG. 3, the chamber 122 is in the collapsed state. When higher quality of sound is desired, the chamber 122 is drawn to the expanded state to increase the volume of the acoustic chamber 12. When the speaker 1 is not used, or quality of sound is not required, the chamber 122 can be collapsed by the band 123 to decrease the volume of the acoustic chamber 12. When fixing the speaker 1 to an electronic device (not shown), the acoustic chamber 12 can be exposed outside of the electronic device.

In this exemplary embodiment, the chamber 122 includes at least one collapsible part 124 and at least one non-collapsible part. Each collapsible part 124 and each non-collapsible part 125 are arranged alternately. When the chamber 122 is drawn to the expanded state, the collapsible part 124 is perpendicular to the non-collapsible part 125 and the chamber 122 is step-like. When the chamber 122 is collapsed to the collapsed state, each collapsible part 124 is collapsed to position all the non-collapsible parts 125 on one plane.

In this embodiment, the collapsible part 124 and the non-collapsible part 125 are made of different material. The collapsible part 124 is soft material that is easily collapsed, such as rubber. The non-collapsible part 125 is material that can improve the quality of the sound output by the speaker 1, such as wood or plastic. When the collapsible part 124 is made of rubber and the non-collapsible part 125 is made of plastic, double-color molding technology can be used to manufacture the chamber 122.

Although, the present disclosure has been specifically described on the basis of preferred embodiments, the disclosure is not to be construed as being limited thereto. Various changes or modifications may be made to the embodiment without departing from the scope and spirit of the disclosure.

What is claimed is:

1. A speaker comprising:

a main body; and an acoustic chamber being fixed to the main body, comprising:

a chamber changeable between a collapsed state with smaller chamber volume and an expanded state with larger chamber volume, comprising:

a plurality of collapsible parts and a plurality of non-collapsible parts, wherein each of the plurality of collapsible parts and each of the plurality of non-collapsible parts are arranged alternately, when the chamber is in the collapsed state, all the collapsible parts are collapsed to make all the non-collapsible parts position in a same plane.

2. The speaker as described in claim 1, wherein the acoustic chamber further comprises a band, the band is fixed to the chamber to operate to change the chamber between the collapsed state and the expanded state.

3. The speaker as described in claim 1, wherein when the chamber is in the expanded state, each of the plurality of collapsible parts is perpendicular to each of the plurality of non-collapsible parts and the chamber is step-like.

4. The speaker as described in claim 1, wherein the plurality of collapsible parts and the plurality of non-collapsible parts are made of different material.

5. The speaker as described in claim 4, wherein the plurality of collapsible parts are made of rubber, and the plurality of non-collapsible parts are made of wood or plastic.

6. The speaker as described in claim 5, wherein the chamber is manufactured by double-color molding technology.

* * * * *